US006461255B1

(12) United States Patent
Smith

(10) Patent No.: US 6,461,255 B1
(45) Date of Patent: Oct. 8, 2002

(54) POWERTUBE

(76) Inventor: Robert F. Smith, 8231 Sir Lionel Pl., Richmond, VA (US) 23237

( * ) Notice: Subject to any disclaimer, the term of this patent is extended or adjusted under 35 U.S.C. 154(b) by 0 days.

(21) Appl. No.: 09/860,501

(22) Filed: May 21, 2001

Related U.S. Application Data

(60) Provisional application No. 60/203,938, filed on May 12, 2000.

(51) Int. Cl.[7] ..... A63B 69/40

(52) U.S. Cl. ..... 473/417; 473/451; 473/453; 473/461

(58) Field of Search ..... 473/417, 422, 473/453, 451, 614, 577, 569, 594, 426, 461, FOR 169, FOR 103

(56) References Cited

U.S. PATENT DOCUMENTS 3,313,505 A * 4/1967 Petrie
4,129,278 A * 12/1978 Bressler
5,029,852 A * 7/1991 Gilfillan
5,540,430 A * 7/1996 Nichols et al.
5,588,646 A * 12/1996 Dickson
5,595,384 A * 1/1997 Hardison, Jr.
5,928,092 A * 7/1999 Keeter et al.
6,139,450 A * 10/2000 Rivers
6,296,582 B1 * 10/2001 Minniear

* cited by examiner

*Primary Examiner*—Paul T. Sewell
*Assistant Examiner*—Nini F. Legesse
(74) *Attorney, Agent, or Firm*—Krieg DeVault Lundy, LLP

(57) ABSTRACT

A baseball training aid includes a hollow tubular member rotatably positioned on an adjustable height stand, for use in practice batting. The hollow tubular member is adjustably positioned to guide a bat during the initial movement of the bat by the batter. The apparatus can be configured as a bat guide, as a ball support, and for aligning the batting swing of a batter. A swing tube is pivotally secured to the base of the powertube apparatus, and may be adjustably positioned in relation to the hollow tubular member. A ball may be placed upon either the swing tube or on the hollow tubular member. The apparatus improves the power developed during a swing, by guiding the initial part of a swing in a forward direction, before the bat is rotated to meet the ball. The apparatus may be adjusted to suit the height and batting stance of the batter, and the hollow tubular member may be rotatably positioned and releasably secured to suit the needs of a variety of batters. The powertube apparatus may be positioned in different ways to improve the batting skills of the batter.

20 Claims, 4 Drawing Sheets

FIG. 3
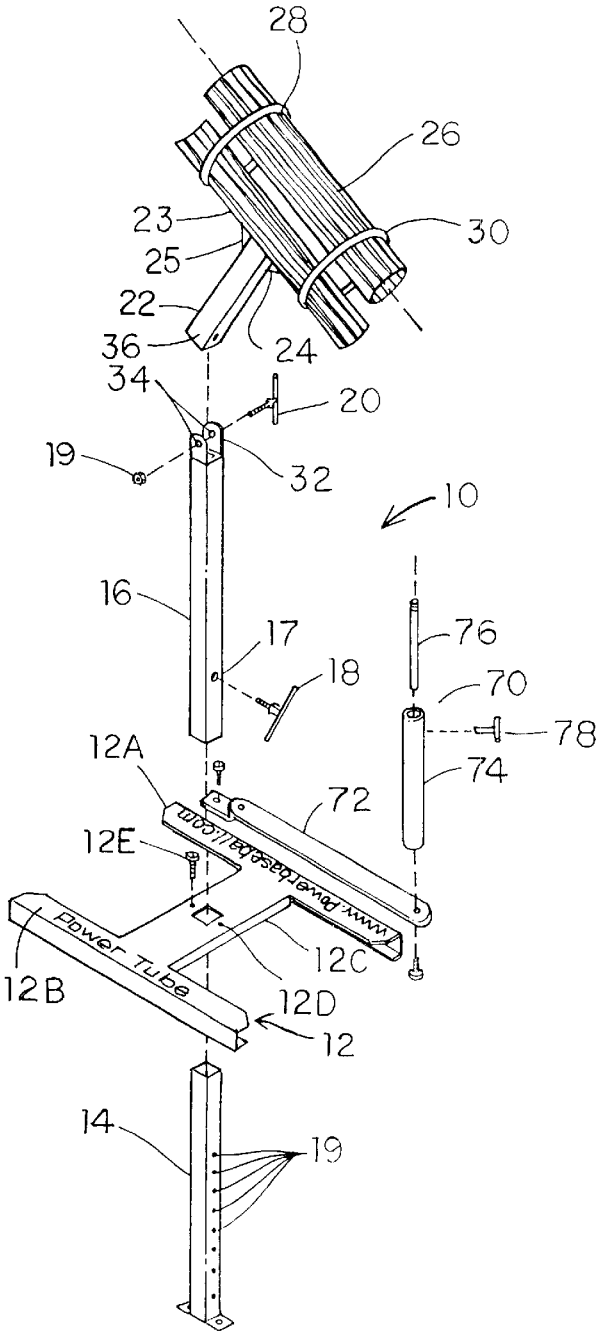
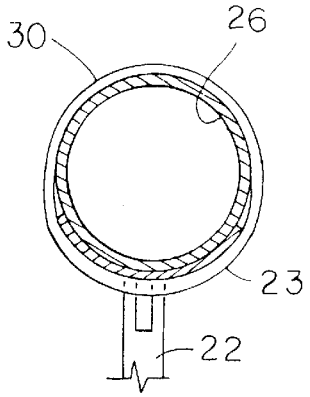
FIG. 4
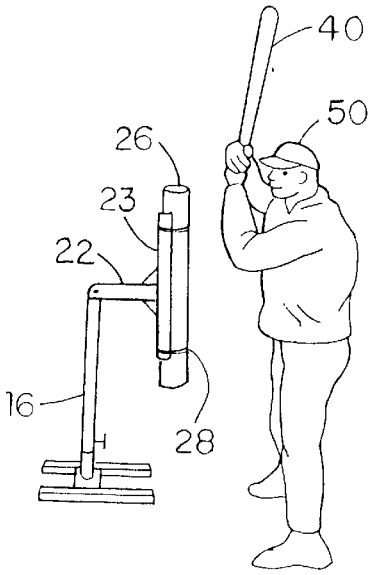
FIG. 5

POWERTUBE

This application claims the benefit of provisional application 60/203,938 filed on May 12, 2000.

FIELD OF THE INVENTION

The present invention relates to training aids for training a batter to hit a ball. More particularly, the invention relates to a powertube training aid apparatus having a bat guide. For purposes of this disclosure, the term ball is intended to mean either a baseball or a softball.

BACKGROUND OF THE INVENTION

Instructional devices for use in sports are known. It is a problem in the art to provide batting instruction which is precise, and provides accurate bat positioning during a batter's swing, in order to improve the batting mechanics, as shown in the following patents.

U.S. Pat. No. 5,322,276 is directed to a bat swing guide. The guide includes a vertical support and a generally semicircular arcuate guide attached to the support, so that a path of travel of the bat follows the arcuate guide.

SUMMARY OF THE INVENTION

From the foregoing it is seen that it is a problem in the art to provide a device meeting the above requirements. According to the present invention, a device is provided which meets the aforementioned requirements and needs in the prior art.

Specifically, the device according to the present invention is a baseball training aid for use in batting practice. The device is a powertube apparatus having a hollow tubular member, which is adjustably supported to guide a bat during the initial swing movement of the bat by the batter. The batter learns to draw the bat from the tube before beginning rotation of the bat. This trains the batter for proper pulling action to get the most power at contact, and reinforces proper swing technique, by staying inside the baseball during the batter's swing.

The powertube apparatus may also be used to support a ball upon the top portion of the elongated hollow tube member, so that the batter aligns the bat in relation to the ball, and planes the bat in relation to the ball through contact, during his swing. This reinforces proper technique during the swing, and keeps the batter from chopping and looping the ball.

The powertube apparatus has further utility, by placing the elongated hollow tube member substantially vertically to train the batter to stay inside the ball by missing the powertube and generating top speed and power at contact.

An object of the present invention is to provide a powertube apparatus, which is adjustable in height.

Another object of the present invention is to provide a powertube apparatus, which is adjustable in inclination between horizontal and vertical positions.

Yet another object of the present invention is to provide a powertube apparatus which is sized to slidably receive a bat within an elongated hollow tube member mounted upon the adjustable frame of the powertube apparatus.

Yet another object of the present invention is to provide a powertube apparatus which provide a pivotal swing guide and resilient ball rest.

Still another object of the present invention is to provide a powertube apparatus which substantially vertically aligns the powertube to train the batter to stay inside of the powertube, by missing the post and generating top speed and power at contact with the ball.

These and other objects according to the present invention are accomplished by provision of a base, a lower support member, an upper support member telescopically mounted in relation to the lower support member, a releasable securement means for adjustably positioning the height of the upper support member in relation to the lower support member, a tube support member pivotally mounted on the upper support member, and an elongated hollow tubular member mounted upon the tube support member. A at least two resilient expandable ring members, such as O-ring members, connect the hollow tubular member to the tube support member. The tubular support member includes a base with a swing arm releasably secured to the base. The swing arm has a lower member and a resilient upper member adjustably positioned in relation to the lower member. The upper member supports a ball upon the distal end, and is pivotally positioned in relation to the base.

Other objects and advantages of the present invention will be more readily apparent from the following detailed description when read in conjunction with the accompanying drawings.

BRIEF DESCRIPTION OF THE DRAWINGS

FIG. 1A shows the bat inserted into the powertube in preparation for swinging the bat.

FIG. 1B shows the bat partially withdrawn from the elongated hollow tubular member as the user shifts weight onto his front foot prior to rotating the bat. The bat's knob is forward while the barrel of the bat is still inside the tubular member.

FIG. 1C shows the rotation of the bat following the release of the bat from the tubular member.

FIG. 1D shows the position of the bat following the completion of the swing at the ball.

FIG. 3 is an exploded view of the powertube apparatus, showing the relationship of the component parts.

FIG. 4 is an end view of a portion of the powertube shown in FIG. 2B, showing one end of the elongated hollow tubular member.

FIG. 5 shows a third use of the powertube apparatus, showing the elongated hollow tubular member substantially vertically aligned, to guide the batter to keep his swing close to his body during the initial portion of the swing.

DETAILED DESCRIPTION OF THE INVENTION

Figures 1A, 1B, 1C, 1D:
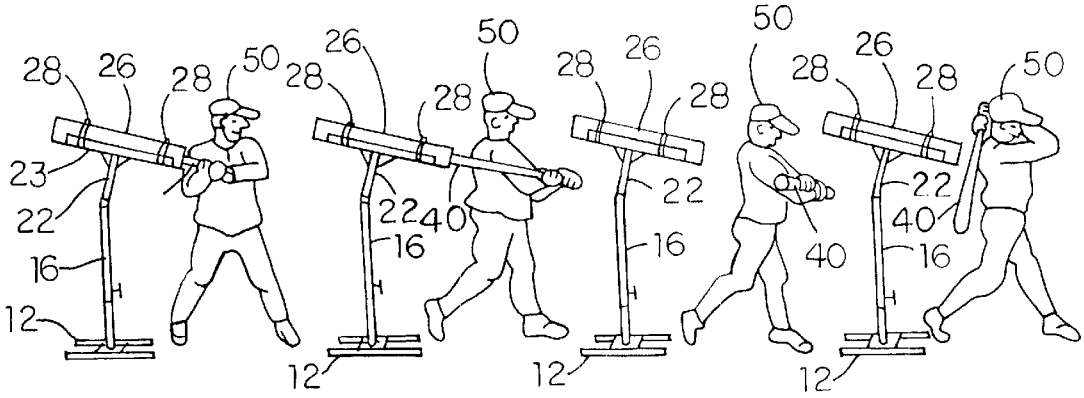
FIG. 1A through FIG. 1D show the progressive movement of a bat as the batter swings the bat at a ball using the tubular member to guide the bat to obtain the proper pulling action.

The powertube apparatus 10 is shown in detail in FIG. 1A through FIG. 5. FIG. 1A through FIG. 1D show the progressive movement of a bat 40 as it is withdrawn from within the tubular member 26 to teach a batter 50 the proper pulling action during the initial movement of the bat 40 to reinforce proper swing technique, while maximizing the ark power of the batter's 50 swing.

For maximum power, the initial part of a batter's 50 swing should ideally be in an inside pulling action in a forward direction, toward the ball 60 to be batted. In a second part of the batter's swing, the bat 40 is released from the inside of the tubular member 26, and then pivoted so that it meets the oncoming ball 60. It is often difficult for the batter 50 to know whether or not the initial part of the swing is being performed correctly. The powertube apparatus 10, shown in FIG. 1A through FIG. 1D, aids the batter 50 in obtaining the desired pulling action to get the most power at contact between the bat 40 and the ball 60.

As best shown in FIG. 3, the powertube apparatus 10 comprises a base portion 12. The base portion 12 is preferably H-shaped, and includes a pair of spaced parallel legs 12A and 12B. The spaced, parallel legs 12A and 12B are connected by a cross bar 12C. A lower support member 14 is releasably secured to the cross bar 12C. The lower support member 14 can extend through an aperture 12D, as shown in FIG. 3, and the lower support member 14 is secured to the base portion 12 with suitable fastening means 12E. The shape of the base 12 is not intended to be limited to an H shape. Other shapes, such as circular, oval or multi-sided shapes may be used. The base portion 12 is sized to support the powertube apparatus 10 during use.

The upper support member 16 is telescopically mounted in relation to the lower support member 14 to provide a suitable height adjustment, preferably between waist and shoulder height. It is within the scope of this invention to have the upper support member 16 be slidably received over the lower support member 14. Alternately, the lower support member 14 may be slidably received over the upper support member 16.

A threaded hole 17 is provided to receive a releasable securement means, such as a threaded T-bar clamp 18, to adjustably position and releasably secure the upper support member 16 in relation to the lower support member 14.

Alternately, the upper support member 16 and/or the lower support member 14 can be formed of smaller elements, which are stackable in order to adjust the total height thereof. (Not shown). All such embodiments are intended to fall within the scope of this disclosure, and the following claims.

The upper support member 16 is pivotally connected and releasably secured to a tube support member 22 by a manually tightenable threaded member 20. A suitable fastening means, such as a nut 19 may be used to further tighten the tube support member 22 to the upper support member 16. Any known type of releasable securement means may be used, without departing from the scope of this disclosure, or from the appended claims.

Figure 2A:
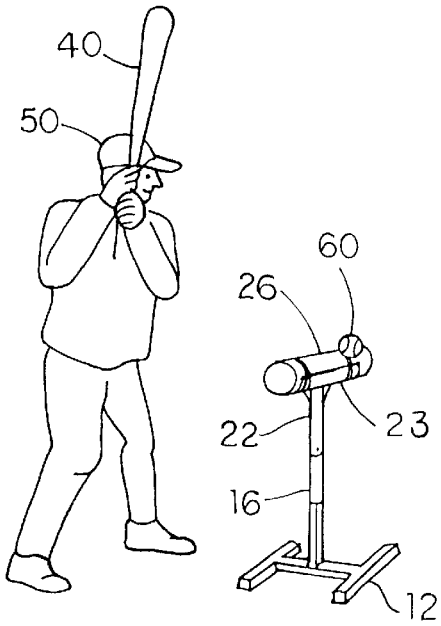
FIG. 2A shows a second use of the powertube apparatus, wherein a ball is placed upon the top portion of the tubular member, as the tubular member guides the bat towards the ball. The bat must be level to the plane of the tubular member to solidly hit the ball.

Preferably, the upper end of the upper support member is a bracket 32 having aligned holes 34 sized to closely receive the threaded member 20 therethrough. The tube support member 22 is sized to fit within the bracket 32, and also has a hole 36 or aperture extending through the tube support member 22 near the lower end, to closely receive the threaded member 20 within the hole 36. With the threaded member 20 lightly engaged, the tube support member 22 is positioned to pivot about the threaded member 20. When the threaded member 20 is tightened, the tube support member 22 is releasably secured at a desired angle in relation to the upper support member 16. The desired angle may be positioned from substantially horizontal as shown in FIG. 2A to substantially vertical, as shown in FIG. 5.

Alternately, any known type of releasable adjustment mechanism may be used, without departing from the scope of this disclosure, or the following claims.

The upper tube support member 22 includes a cross member 23. Optional opposing struts 24, 25 may be added between opposing sides of the upper tube support member 22 and the cross member 23 for additional strength. An elongated hollow tubular member 26 is connected to the tube support member 23, preferably with one or more resilient O-ring members 28. The manually tightenable threaded member 20 can be loosened to permit rotational adjustment of the tube support member 22 relative to the upper support member 16.

As further shown in FIG. 1A through FIG. 1D, the elongated hollow tubular member 26 may be angled slightly downwardly, from five degrees to thirty degrees, and releasably secured with the threaded member 20, to adjustably position the tilt of the hollow tubular member 26.

The elongated hollow tubular member 26 is preferably secured to the tube support member 23 with resilient, expandable ring members 28, such as O-rings, as best shown in FIG. 3. While two expandable ring members 28 are shown in FIG. 3, it will be understood that additional expandable ring members 28 may be used. Additionally, the invention is not limited to the use of expandable ring members 28 to secure the tubular member 26 to the tube support member 23. Other known connection means may be used, such as screws, bolts, clamps, rivets, etc. Preferably, the tubular member 26 is releasably secured to the tube support member 23 for ease of rotating or replacing the tubular member 26 when worn or damaged. An end view of the tubular member 26 is shown in FIG. 4.

Preferably, the elongated hollow tubular member 26 is formed of a spiral-type corrugated plastic tube, such as commonly used for irrigation or drainage purposes, and widely available in many hardware stores. Alternatively, the tubular member 26 can be a smooth tubular member 26 without any corrugations, and may be non-circular or multisided to suit user preference. The hollow inner portion of the tubular member 26 is sized to slidably receive a bat 40 therein. Different size bats 40 may require a different sized hollow tubular member 26. Alternately, the tubular member 26 may be integrally formed with the tube support member 22, to suit manufacturing preference. All such variations are contemplated as being within the scope of the present invention.

Figure 2B:
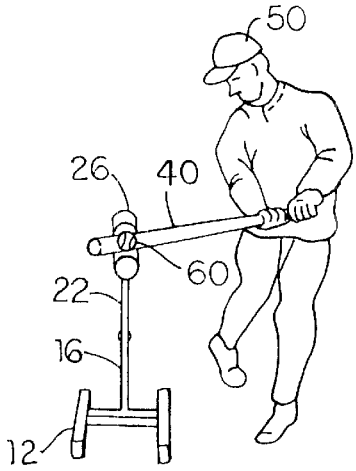
FIG. 2B shows the bat aligned with the substantially horizontal tubular member as the bat strikes the ball on the same plane as the ball for solid contact.

The powertube apparatus 10 may be alternately positioned as shown in FIGS. 2A and 2B. In this embodiment, the height of the tubular member 26 is lowered considerably, as compared to the height shown in FIG. 1A through FIG. 1D. The tubular member 26 may be tilted to adjust to the desired angle of swing of the bat 40 by the batter 50. The height is adjusted by telescopically adjusting the upper support member 16 relative to the lower support member 14, in the manner previously described.

A ball 60 is placed on top of the tubular member 26, either at the end as shown in FIG. 2A and FIG. 2B, or in the middle (not shown) of the tubular member 26. One or more tee locations 29 may be provided on the outer wall of the tubular member 26 to more easily position a ball 60 on the hollow tubular member 26. The tee locations 29 may be in the form of a flat, or aperture located on the top portion of the tubular member 26.

The batter 50 is guided by the position of the tubular member 26 as the bat approaches the ball 60. When used as shown in FIG. 2A and FIG. 2B, the powertube apparatus 10 reinforces proper swing technique, and teaches a batter 50 to avoid chopping and looping the ball 60. The tubular member 26 acts as a flat tee surface, and provides instant feedback when the batter 50 fails to address the ball 60 properly.

The power tube apparatus 10 may also be used, as shown in FIG. 5. In this embodiment, the elongated hollow tubular member 26 is placed substantially vertically, and positioned in relation to the batter 50 to ensure the batter 50 keeps the swing close to the batter's body during the initial part of the swing. Failure to do so will result in the bat 40 hitting the elongated hollow tubular member 26.

Figure 6:
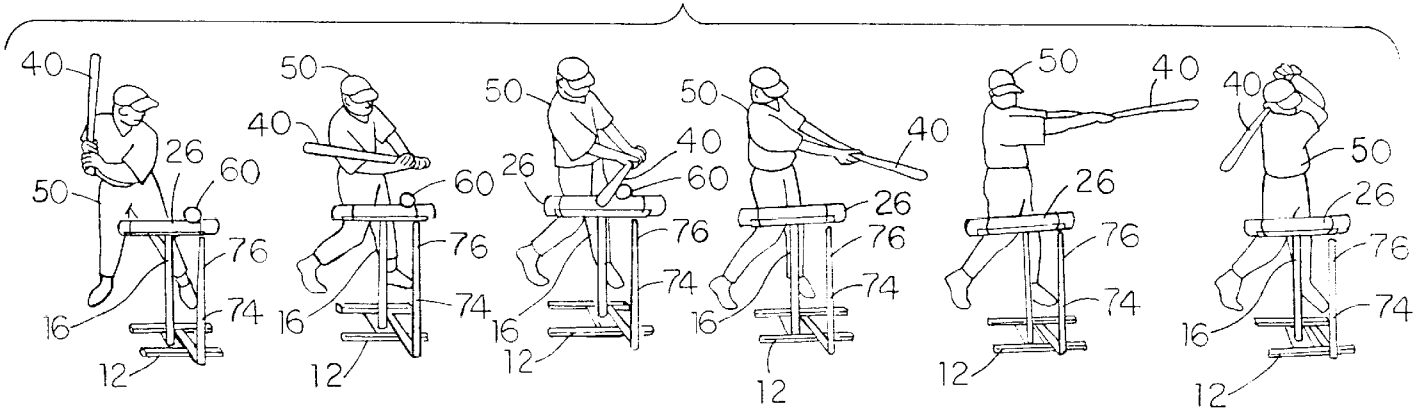
FIG. 6 is a sequential view of a batter hitting a ball off the top portion of the elongated hollow tubular member, which is substantially horizontally positioned.
Figure 7:
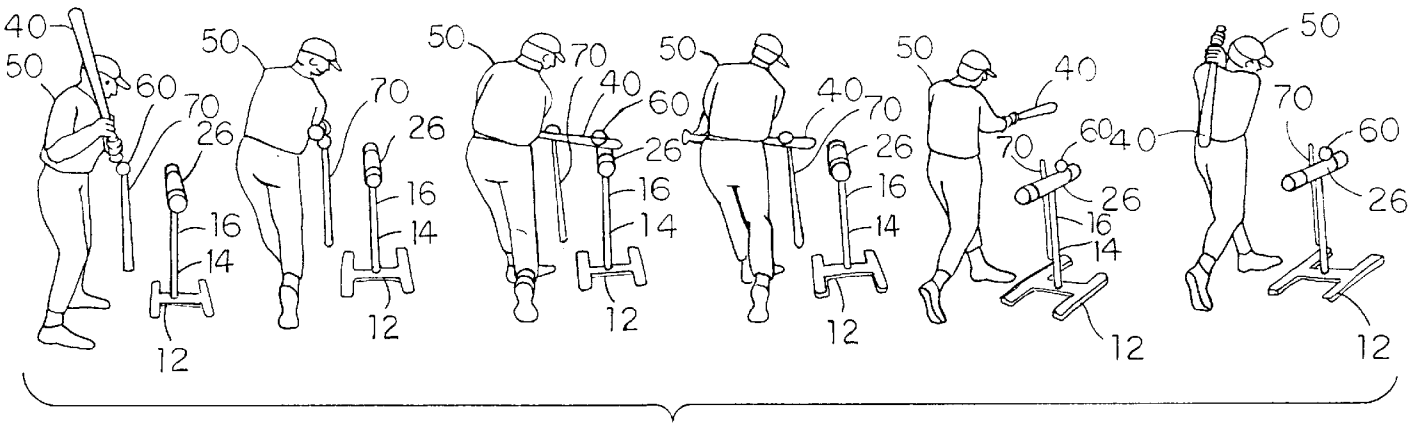
FIG. 7 is a sequential view of a batter hitting a first ball off the swing tee, while avoiding a second ball placed upon the elongated hollow tubular member, in a first embodiment of a double tee drill.
Figure 8:
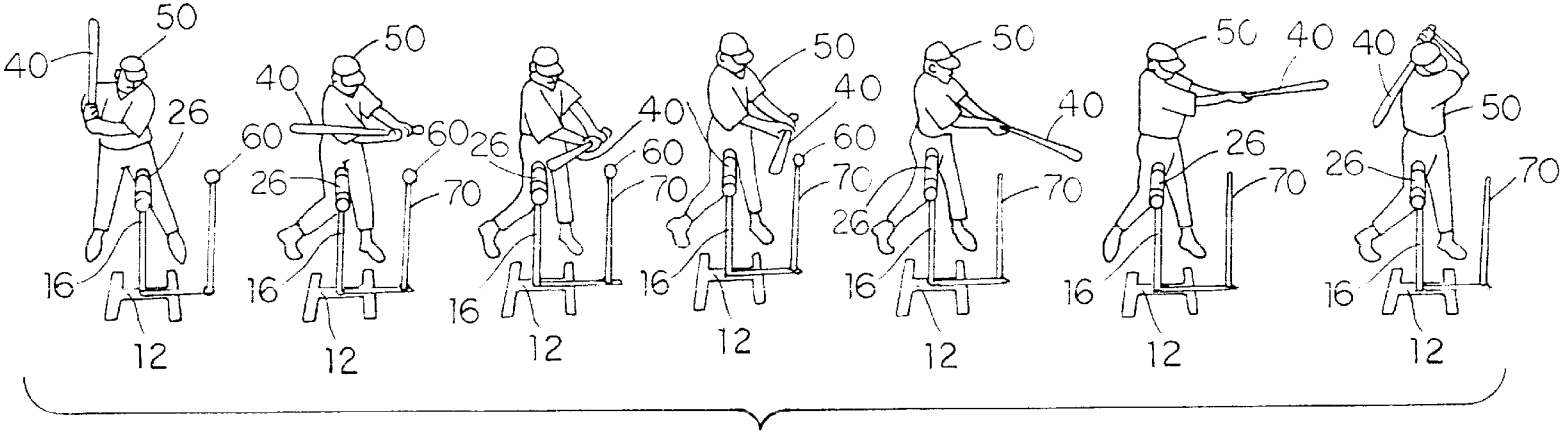
FIG. 8 is a sequential view of a batter hitting a ball off the swing tee, with the elongated hollow tubular member positioned behind the swing tee.

As shown in FIG. 3, a swing tee 70 is pivotally secured to the base 12, and may be adjustably positioned in relation to the base 12, to support the ball 60 in spaced relation from the elongated hollow tubular member 26, as best shown in FIG. 6, 7 and 8. The swing tee 70 includes a pivotal base member 72, a lower ball support tube 74 and an upper ball support tube 76. The upper ball support tube 76 is adjustable in height in relation to the lower ball support tube 74, and may be secured at the desired height with a T-clamp 78, or by other known releasable securement means. The upper ball support tube 76 is preferably resilient and bendable, such as a rubber support tube 76, and the distal end o9f the support tube 76 is sized to support a ball thereon.

FIG. 6 is a sequential view of a batter 50 hitting off the elongated hollow tubular member 26, with the elongated hollow tubular member 26 positioned in a flat tee orientation. The elongated hollow tubular member 26 is set up so that it is facing in the direction the batter 50 wants to hit the ball 60. The ball 60 is positioned on one of the tee positions 29 near the forward end of the tubular member 26.

Preferably there are three radially spaced tees 29 located near each end of the tubular member 26. This allows the player to rotate the tubular member 26 so the tubular member 26 does not become flat on one side from repeated use.

The batter 50 hits the ball in the direction the elongated hollow tubular member 26 is pointing. The elongated hollow tubular member 26 may be selectively pointed in the direction of the pitcher, the second baseman, or the shortstop. The batter 50 will get instant feed back on good hits and poor hits on each swing. For advanced drill, the elongated hollow tubular member 26 is pointing up the middle at the pitcher, and the batter 50 hits the ball 60 to the second baseman side of second base. When the ball 60 is hit solidly, the ball 60 will come off the tee 29 on the same line as the height of the tee 29 on the elongated hollow tubular member 26. If the ball 60 jumps up high or rolls on the ground, the batter 50 knows these are not good hits. There is an unmistakable feel on good hits and bad hits, and the batter 50 will know the difference.

FIG. 7 is a sequential view of a double tee drill. With this drill, a first ball 60 is placed on the tee 29 located on the top portion of the elongated hollow tubular member 26, and the batter 50 is instructed to hit the ball 60 to the second base side of the field. Then a second ball 60 is placed on the swing tee 70 at a location on the inside of the strike zone, and the batter 50 pulls the ball 60 to the shortstop side of the field. Then both balls 60 are positioned on the tee 29 located on the elongated hollow tubular member 26 and on the swing tee 70, and a player or coach calls out "inside pitch" or "outside pitch", and the batter 50 hits the ball 60 called. This drill teaches the batter 50 to hit both inside and outside pitches.

FIG. 8 is a drill using the elongated hollow tubular member 26 as a loop guide. To setup, the elongated hollow tubular member 26 is placed in a cross-position facing the pitcher. The swing tee 70 is set in front of the elongated hollow tubular member 26, so the batter 50 must clear the tubular member 26 to hit the ball 60 located on the swing tee 70. The batter 50 learns to position the plane of the bat 40 on the ball 60, as the bat 40 moves through the strike zone.

Figure 9:
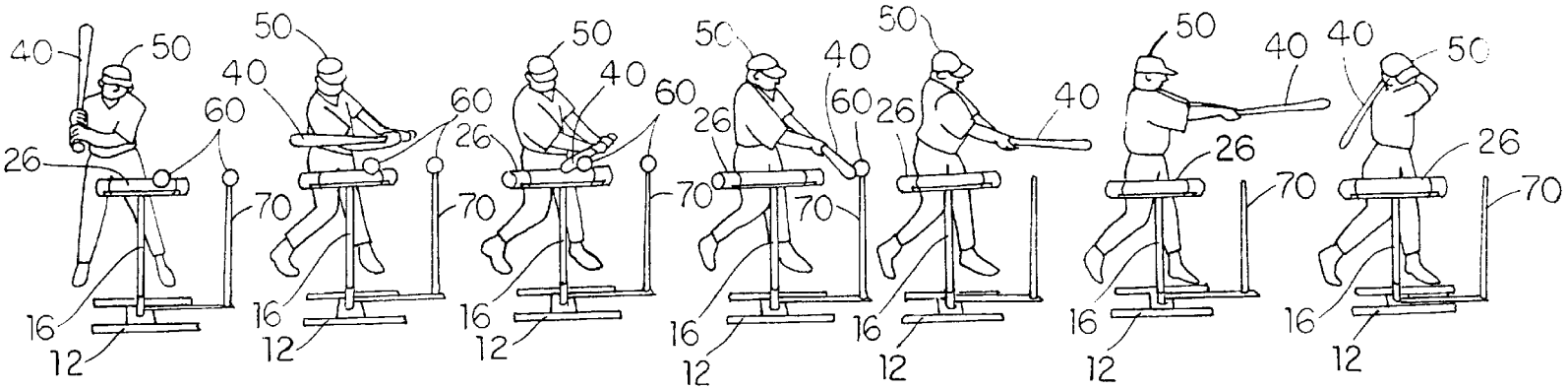
FIG. 9 is a sequential view of a batter hitting a first ball off the elongated hollow tube member and a second ball off the swing tee, in a second embodiment of a double tee drill.

FIG. 9 is a second version of the double tee drill. The tubular member tee 29 is placed forward towards the pitcher, with the swing tee 70 positioned in front of the elongated hollow tubular member 26 at the same height as the elongated hollow tubular member 26. A first ball 60 is placed on the tubular member tee 29, and a second ball 60 is placed on the swing tee 70. The batter 50 is instructed to hit the first ball 60 toward second base, and the second ball 60 should be hit towards the shortstop. This teaches the batter 50 to stay on plane with the ball 60 through the strike zone.

Thus, the tubular member 26 is adjustably positioned and combined with a swing tee 70, and the combination may be adjusted to many selected positions, which are helpful in instructing a batter 50 to improve their batting technique during practice. The powertube apparatus 10 being thus described in terms of a preferred embodiment, it will be evident that the same may be varied in many ways, and such adaptations and variations are intended to be included within the scope of the following claims.

I claim:

1. A powertube apparatus for training a batter to hit a ball with a bat, which comprises:

a) a base member for supporting the powertube apparatus above the ground;

b) a lower support member releasably secured to said base member, said lower support member extending upwardly from the base member, with a plurality of vertically aligned apertures extending in spaced relation through said lower support member;

c) an upper support member having a lower end and an upper end, said lower end of the upper support member slidably received in relation to said lower support member, said upper support member having at least one aperture in said lower end in alignment with a selected one of said plurality of spaced apertures in said lower support member to selectively adjust the height of the upper support member in relation to the lower support member; said upper end of said upper support member further having a pivot bracket with aligned holes sized to receive a releasable fastening means therethrough;

d) a tube support member having a pivot end and a tube support end, the pivot end pivotally secured in relation to said pivot bracket on said upper support member, said tube support member further having an elongated tube support secured to the tube support end of the tube support member;

e) an elongated hollow tube member sized to slidably receive a bat therein, the elongated hollow tube member releasably secured to said tube support member; and the upper support member is adjustably positioned in relation to the lower support member to position the elongated hollow tube member between a batter's waist and a batter's shoulders, and the upper support member is pivotally secured between horizontal and vertical positions.

2. The powertube apparatus of claim 1, wherein the base member comprises two parallel spaced leg portions extending from a central cross brace, and said lower support member releasably secured to said central cross brace.

3. The powertube apparatus of claim 1, wherein a t-handle is threadably secured in the aperture in the lower end of the upper support member, and positioned to engage a selected aperture in said plurality of apertures located in the lower support member, to releasably secure the upper support member in relation to the lower support member, and to adjustably position the elongated hollow tube member between waist and shoulder positions.

4. The powertube apparatus of claim 1, wherein said pivot bracket is releasably secured to said pivot end of said tube support member with a T-handle which extends through the aligned apertures in said pivot bracket and threadably engages a nut secured to the pivot bracket, and wherein the T-handle is tightened to secure the pivot end of said tube support member to the pivot bracket at an angle selected between horizontal and vertical alignment in relation to the base member.

5. The powertube apparatus of claim 1, wherein the elongated hollow tube member is releasably secured to the tube support member with at least two elastomeric bands.

6. The powertube apparatus of claim 1, wherein the elongated hollow tube member is formed as a spiral-type corrugated plastic tube.

7. The powertube apparatus of claim 1, wherein at least one ball aperture is provided in the top portion of the elongated hollow tube member, for ease of positioning a ball upon said ball aperture.

8. The powertube apparatus of claim 1, wherein the elongated hollow tube is angled from five degrees to thirty degrees downwardly at shoulder height, and the batter inserts the bat within the elongated hollow tube prior to swinging the bat, and the bat is withdrawn from the hollow tube at the start of the batter's swing, prior to rotating the bat to hit the ball.

9. The powertube apparatus of claim 1, wherein the elongated hollow tube is positioned horizontally at about waist height, and a ball is placed upon the top of the elongated hollow tube, and the batter swings the bat in alignment with the elongated hollow tube to hit the ball.

10. The powertube apparatus of claim 1, wherein the elongated hollow tube is positioned vertically in relation to the batter to ensure the batter's swing is close to their body during the initial part of the swing.

11. The powertube apparatus of claim 1, wherein a swing tee has a lower ball support tube with an upper ball support tube adjustably positioned and releasably secured in relation to the lower support tube, and the swing tee is releasably secured to an extension which is pivotally secured to the base portion of the powertube apparatus.

12. The powertube apparatus of claim 11, wherein the upper ball support tube is made of a resilient material sized to support the ball upon the distal end of the upper ball support tube.

13. A powertube apparatus for training a batter to hit a ball with a bat, which comprises:

f) a base member for supporting the powertube apparatus above the ground;

g) a lower support member releasably secured to said base member, said lower support member extending upwardly from the base member, with a plurality of vertically aligned apertures extending in spaced relation through said lower support member;

h) an upper support member having a lower end and an upper end, said lower end of the upper support member slidably received in relation to said lower support member, said upper support member having at least one aperture in said lower end in alignment with a selected one of said plurality of spaced apertures in said lower support member to selectively adjust the height of the upper support member in relation to the lower support member; said upper end of said upper support member further having a pivot bracket with aligned holes sized to receive a releasable fastening means therethrough;

i) a tube support member having a pivot end and a tube support end, the pivot end pivotally secured in relation to said pivot bracket on said upper support member, said tube support member further having an elongated tube support secured to the tube support end of the tube support member;

j) an elongated hollow tube member sized to slidably receive a bat therein, the elongated hollow tube member releasably secured to said tube support member;

k) a swing tee with a lower ball support tube and an upper resilient ball support tube adjustably positioned and releasably secured in relation to the lower support tube, the swing tee releasably secured to a pivot arm pivotally extending from the base portion of the power tube apparatus; and the upper support member is adjustably positioned in relation to the lower support member to position the elongated hollow tube member between a batter's waist and a batter's shoulders, and the upper support member is pivotally secured between horizontal and vertical positions.

14. The powertube apparatus of claim 13, wherein the base member comprises two parallel spaced leg portions extending from a central cross brace, and said lower support member is releasably secured to said central cross brace.

15. The powertube apparatus of claim 13, wherein the elongated hollow tube member is formed as a spiral-type corrugated plastic tube, and the elongated hollow tube member is releasably secured to the tube support member with at least two elastomeric bands.

16. The powertube apparatus of claim 13, wherein at least one ball aperture is provided in the top portion of the elongated hollow tube member, for ease of positioning a ball upon the top portion of said elongated hollow tube member.

17. The powertube apparatus of claim 13, wherein the elongated hollow tube member is angled downwardly from five degrees to thirty degrees at shoulder height, and the batter inserts the bat within the elongated hollow tube member prior to swinging the bat, and wherein the bat is slidably withdrawn from the hollow tube member at the start of the batter's swing, prior to rotating the bat to hit the ball.

18. The powertube apparatus of claim 13, wherein the elongated hollow tube member is positioned horizontally at about waist height, and a ball is placed upon the top portion of the elongated hollow tube member, and the batter swings the bat in alignment with the elongated hollow tube member to hit the ball.

19. The powertube apparatus of claim 13, wherein the elongated hollow tube member is positioned vertically in relation to the batter to ensure the batter's swing is close to their body during the initial part of the swing.

20. A powertube apparatus for training a batter to hit a ball with a bat, which comprises:

k) a base member for supporting the powertube apparatus above the ground;

l) a lower support member releasably secured to said base member, said lower support member extending upwardly from the base member, with a plurality of vertically aligned apertures extending in spaced relation through said lower support member;

m) an upper support member having a lower end and an upper end, said lower end of the upper support member slidably received in relation to said lower support member, said upper support member having at least one aperture in said lower end in alignment with a selected one of said plurality of spaced apertures in said lower support member to selectively adjust the height of the upper support member in relation to the lower support member; said upper end of said upper support member further having a pivot bracket with aligned holes sized to receive a releasable fastening means therethrough;

n) a tube support member having a pivot end and a tube support end, the pivot end pivotally secured in relation to said pivot bracket on said upper support member, said tube support member farther having an elongated tube support secured to the tube support end of the tube support member;

o) an elongated hollow tube member sized to slidably receive a bat therein, the elongated hollow tube member releasably secured to said tube support member;

k) a swing tee with a lower ball support tube and an upper resilient ball support tube adjustably positioned and releasably secured in relation to the lower support tube, the swing tee releasably secured to a pivot bar pivotally secured to the base portion of the powertube apparatus;

the upper support member is adjustably positioned in relation to the lower support member to place the elongated hollow tube member between a batter's waist and a batter's shoulders, and the upper support member is pivotally secured between horizontal and vertical positions; enabling the elongated hollow tube member to be selectively positioned to angle the elongated hollow tube downwardly from five degrees to thirty degrees at shoulder height, to enable the batter to insert the bat within the elongated hollow tube prior to swinging the bat, and the bat is slidably withdrawn from the hollow tube member at the start of the batter's swing, prior to rotating the bat to hit the ball; the elongated hollow tube member is alternately positioned horizontally at about waist height, and a ball is placed upon the top portion of the elongated hollow tube member, and the batter swings the bat in alignment with the elongated hollow tube member to hit the ball; and the elongated hollow tube member is further alternately positioned vertically in relation to the batter to ensure the batter's swing is close to their body during the initial part of the swing.

* * * * *